US007818823B1

(12) United States Patent
Thomas

(10) Patent No.: US 7,818,823 B1
(45) Date of Patent: Oct. 26, 2010

(54) COMBINATION URINAL/TOILET FLUSHER AND GRABBER ASSEMBLY

(76) Inventor: Clarence Thomas, 111-35 207$^{th}$ St., Queens Village, NY (US) 11429

( * ) Notice: Subject to any disclaimer, the term of this patent is extended or adjusted under 35 U.S.C. 154(b) by 701 days.

(21) Appl. No.: 11/378,522

(22) Filed: Mar. 17, 2006

(51) Int. Cl.
*E03D 5/00* (2006.01)

(52) U.S. Cl. ..... 4/249; 4/405; 16/413

(58) Field of Classification Search ..... 4/405, 4/249, 421, 413, 422, 426, DIG. 12; 16/443, 16/906, 413
See application file for complete search history.

(56) References Cited

U.S. PATENT DOCUMENTS 3,138,211 A * 6/1964 Blom ..... 172/371
4,835,799 A 6/1989 Beelart, Jr.
4,979,238 A 12/1990 Clark
5,619,758 A 4/1997 Burkett
5,713,614 A * 2/1998 Anderson ..... 292/336.3
5,737,778 A 4/1998 Black
5,898,975 A * 5/1999 Hancock ..... 16/114.1
6,163,894 A 12/2000 Simonds
6,305,032 B1 10/2001 Jones
6,499,155 B1 12/2002 Barrios

* cited by examiner

*Primary Examiner*—Gregory L Huson
*Assistant Examiner*—Karen Younkins
(74) *Attorney, Agent, or Firm*—Richard M. Goldberg

(57) ABSTRACT

A combination urinal/toilet flusher and grabber assembly includes a first resilient U-shaped main body having spaced apart side walls connected by a top wall such that an object can be grasped by compression of outer surfaces of the side walls toward each other. A first hollow member extends from one end of the main body for receiving a urinal/toilet flusher handle. A first tongue extends from an opposite end of the main body and has an opening for receiving a flusher handle. An inner member includes a second resilient main body having spaced apart wings connected together by a top wall, and a second hollow member extending from one end thereof and removably fit within the first hollow member for receiving a flusher handle such that the wings can grasp an object when the side walls are compressed toward each other.

16 Claims, 13 Drawing Sheets

COMBINATION URINAL/TOILET FLUSHER AND GRABBER ASSEMBLY

BACKGROUND OF THE INVENTION

The present invention relates generally to a device for enabling a person to avoid contact with restroom surfaces, and more particularly, is directed to a combination urinal/toilet flusher and grabber assembly.

It is known that public restrooms are replete with germs. Thus, for example, when a man uses a urinal, the flush handle has many germs from prior users. These germs are transferred to the person who touches the flush handle. The same applies to the flush handles of toilets in public restrooms. In addition, many people who use a public restroom do not wash their hands prior to leaving, so that the doorknobs and other objects, such as the paper dispensers, soap dispensers and the like, are also full of germs.

Although it is known to use a tubular member to flush a toilet, it is desirable to provide some device that also provides a disposable insert inside the tubular flushing member, provides separate elements for flushing toilet and urinal handles, and also provides a member which can be used for grasping doorknobs and other objects, such as the paper dispensers, soap dispensers and the like in a restroom.

SUMMARY OF THE INVENTION

Accordingly, it is an object of the present invention to provide a combination urinal/toilet flusher and grabber assembly that overcomes the problems with the aforementioned prior art.

It is another object of the present invention to provide a combination urinal/toilet flusher and grabber assembly for enabling a person to depress the flush handles of urinals and toilets and to contact various surfaces in a public restroom without the transfer of germs to that person.

It is still another object of the present invention to provide a combination urinal/toilet flusher and grabber assembly that is multi-functional and relatively compact.

It is yet another object of the present invention to provide a combination urinal/toilet flusher and grabber assembly that is easy to use and relatively inexpensive to manufacture.

In accordance with an aspect of the present invention, a combination urinal/toilet flusher and grabber assembly, including an outer member having a first resilient main body having spaced apart side walls connected by a top wall such that an object can be grasped by compression of outer surfaces of the side walls toward each other, and a first hollow member extending from one end of the main body for receiving a urinal/toilet flusher handle.

The hollow member preferably has a generally hollow cylindrical shape.

In one embodiment, the side walls include finger receiving portions on an outer surface thereof for providing the compression. In this embodiment, there are also grabber members secured to lower ends of the side walls for grabbing a generally cylindrical object. Each grabber member has a generally semi-cylindrical configuration having a concave inner surface, and the concave inner surfaces of the semi-cylindrical grabber members face each other. At least one grabber member includes a finger receiving member on an outer surface thereof for further aiding in the compression.

There is also preferably an inner member removably held within the outer member. The inner member includes a second resilient main body having spaced apart wings connected together by a top wall, and a second hollow member extending from one end of the second main body for receiving a urinal/toilet flusher handle, the second hollow member being dimensioned to removably fit within the first hollow member such that the wings are positioned between the side walls so that an object can be grasped by the wings by compression of outer surfaces of the side walls toward each other. Preferably, at least a portion of an inner surface of each wing includes a roughened section for gripping of the object.

In accordance with another aspect of the present invention, a combination urinal/toilet flusher and grabber assembly includes an outer member having a first resilient main body having spaced apart side walls connected by a top wall such that an object can be grasped by compression of outer surfaces of the side walls toward each other, and a first tongue extending from one end of the main body, the tongue including an opening for receiving a urinal/toilet flusher handle.

In this embodiment as well, there are finger receiving portions on outer surfaces of the side wall, semi-cylindrical grabber members secured to lower ends of the side walls, and a finger receiving member on at least one grabber member.

In accordance with still another aspect of the present invention, a combination urinal/toilet flusher and grabber assembly includes a first resilient main body having spaced apart side walls connected by a top wall such that an object can be grasped by compression of outer surfaces of the side walls toward each other, a first hollow member extending from one end of the main body for receiving a urinal/toilet flusher handle, and a first tongue extending from an opposite end of the main body, the tongue including an opening for receiving a urinal/toilet flusher handle.

The above and other objects, features and advantages of the invention will become readily apparent from the following detailed description thereof which is to be read in connection with the accompanying drawings.

DETAILED DESCRIPTION

Figure 1:
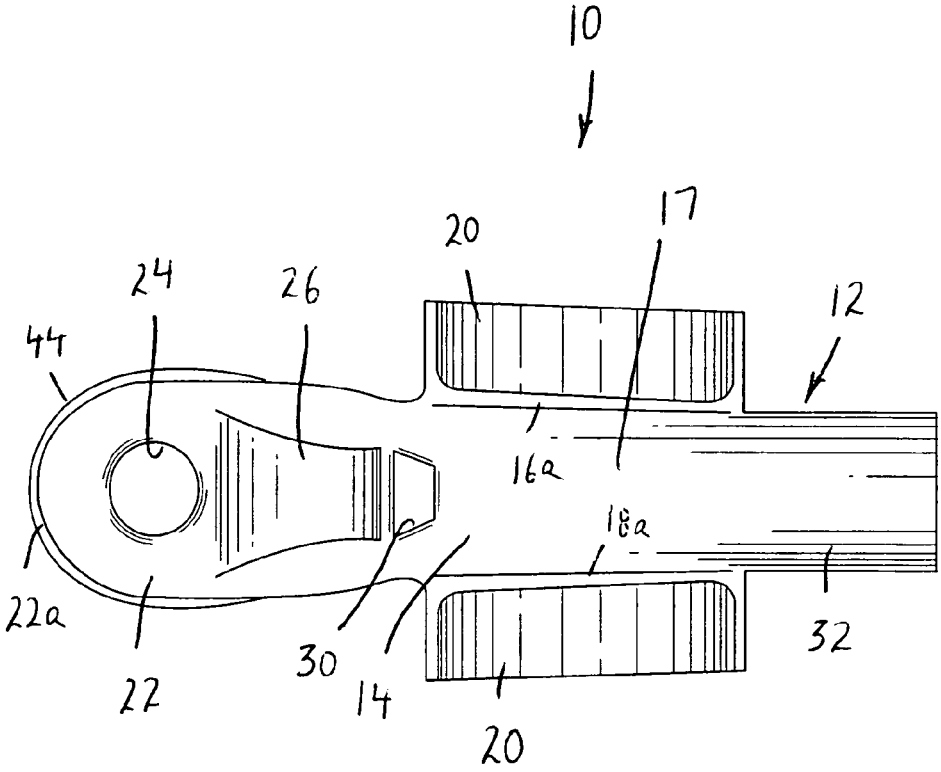
FIG. 1 is a top plan view of a combination urinal/toilet flusher and grabber assembly according to a first embodiment of the present invention.
Figure 2:
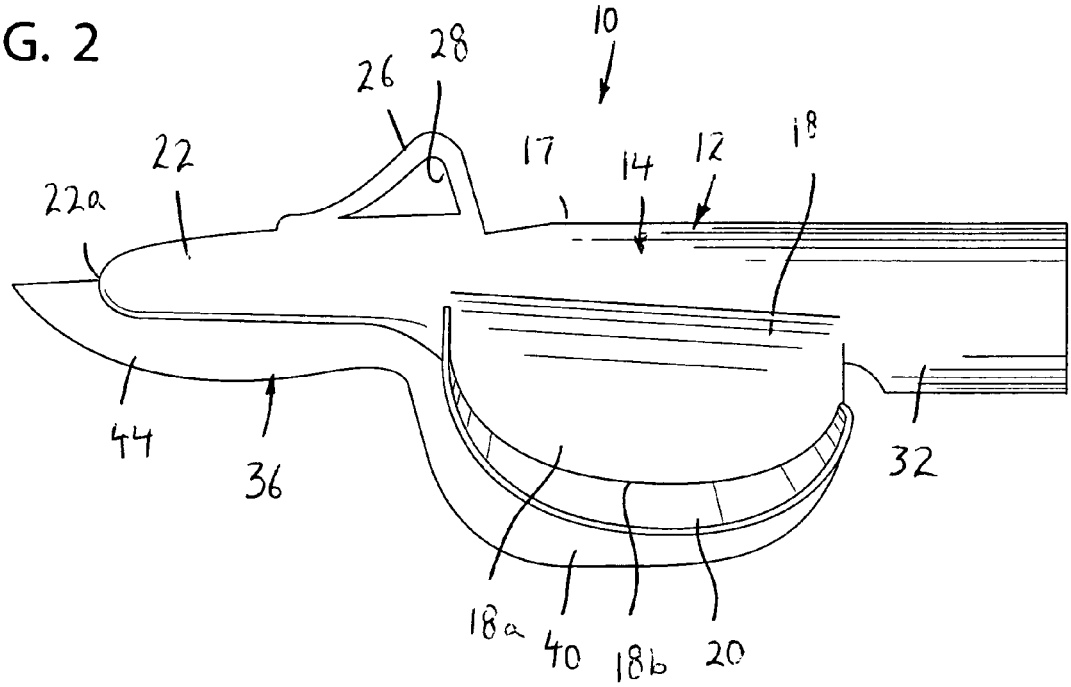
FIG. 2 is a side elevational view of the combination urinal/toilet flusher and grabber assembly.
Figure 3:
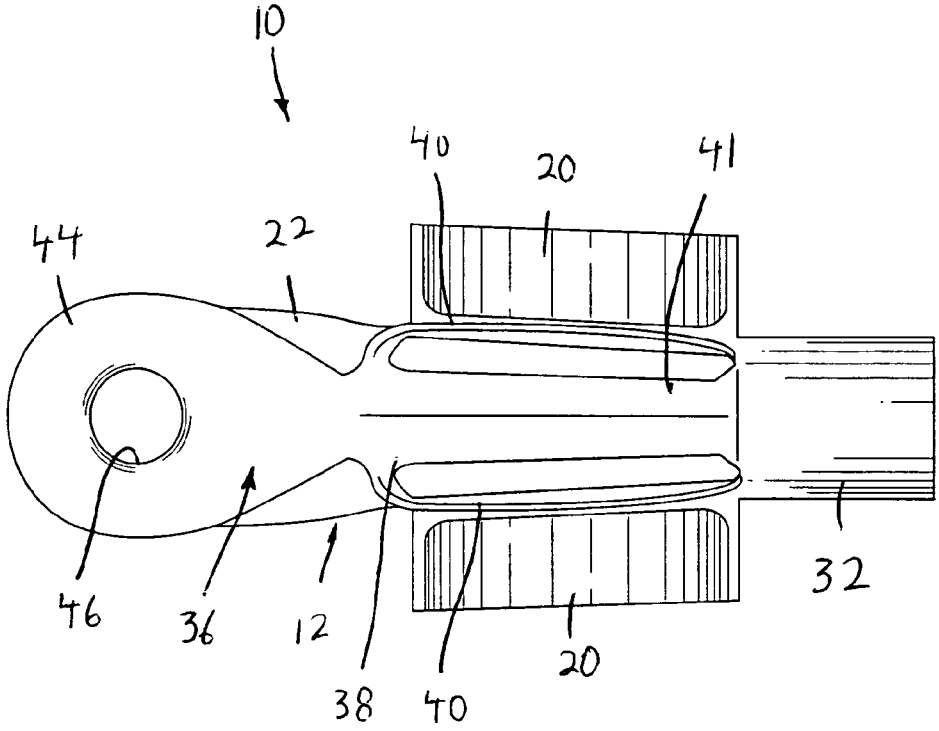
FIG. 3 is a bottom plan view of the combination urinal/toilet flusher and grabber assembly.
Figure 4:
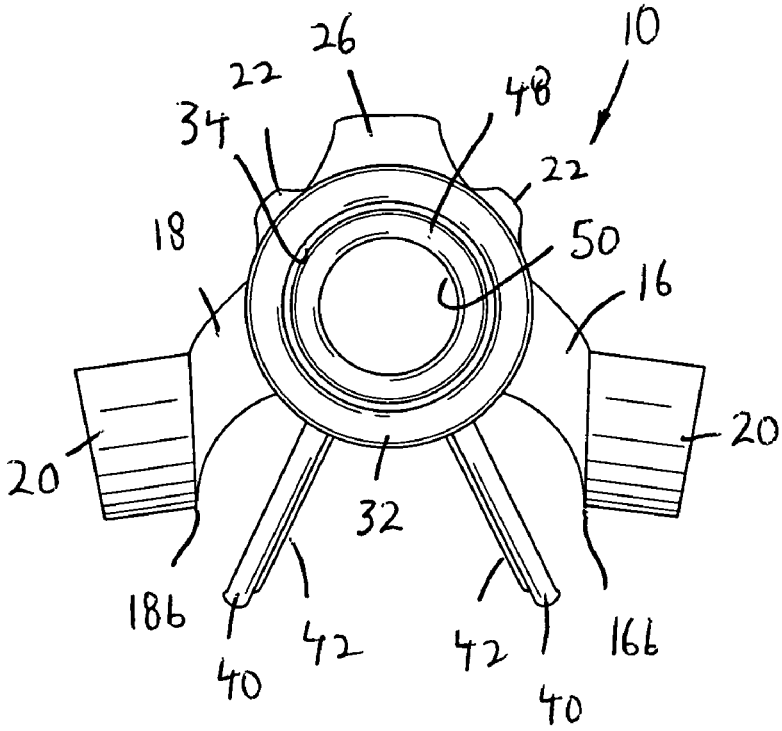
FIG. 4 is a rear elevational view of the combination urinal/toilet flusher and grabber assembly.
Figure 5:
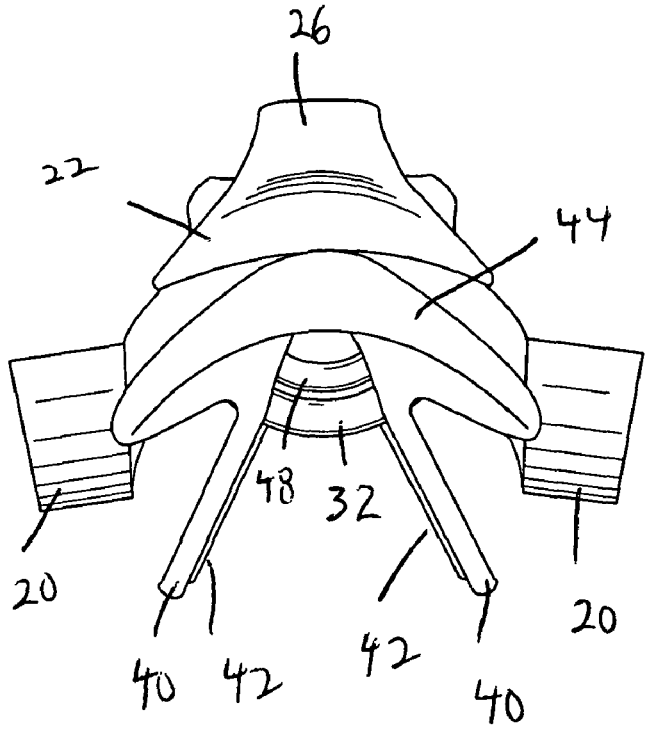
FIG. 5 is a front elevational view of the combination urinal/toilet flusher and grabber assembly.
Figure 6:
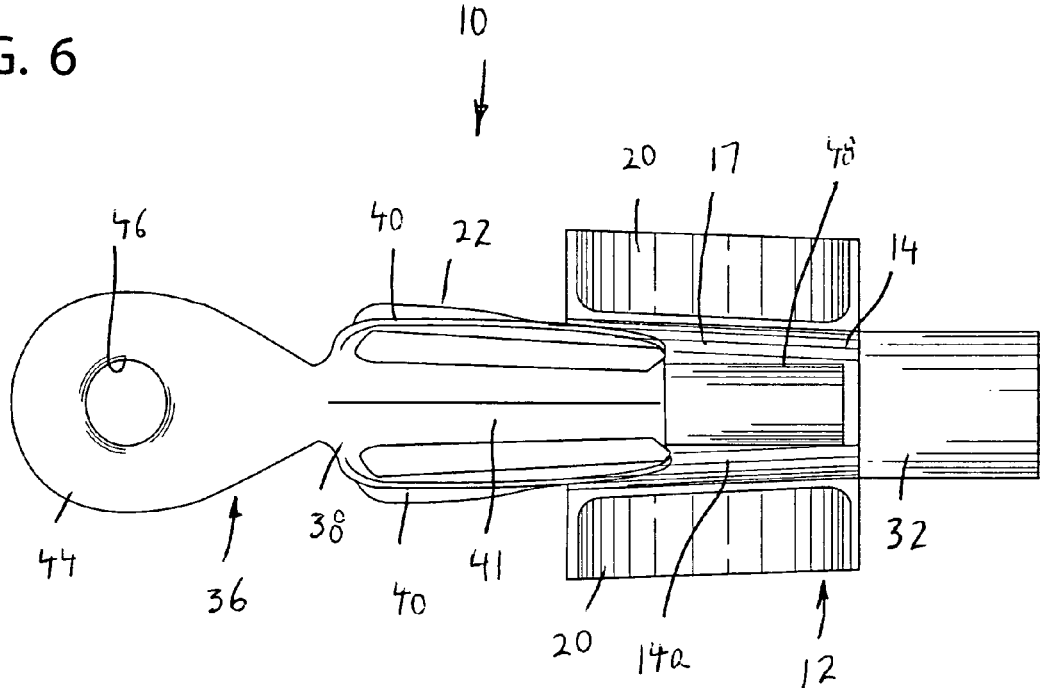
FIG. 6 is a partially exploded bottom plan view of the combination urinal/toilet flusher and grabber assembly.

Referring to the drawings in detail, and initially to FIGS. 1-6, a combination urinal/toilet flusher and grabber assembly 10 according to a first embodiment of the present invention includes an outer member 12 which is to be held by a user. Outer member 12 includes a main U-shaped body 14 having downwardly and outwardly diverging sidewalls 16 and 18 connected together by a top wall 17. A channel 14*a* is defined between sidewalls 16 and 18. The lower portions 16*a* and 18*a* of sidewalls 16 and 18, respectively, extend vertically down, generally parallel to each other, and each has a generally half elliptical shape with a lower curved edge 16*b* and 18*b*, respectively. Shrouds 20 having the same shape as lower curved edges 16*b* and 18*b* each have one edge connected to lower curved edges 16*b* and 18*b*, respectively, and extend outwardly therefrom.

A forwardly extending tongue 22 extends contiguously from the front of main body 14 and has a length similar to that of main body 14. Tongue 22 has a generally rounded front edge 22*a* and includes a central opening 24 near the front end thereof. In addition, an upwardly extending substantially V-shaped member 26 having a transverse opening 28 is secured to the upper surface of tongue 22. A portion of tongue 22 can be cut-away at opening 30 to help form V-shaped member 26.

A rearwardly extending cylindrical member 32 extends contiguously from the rear edge of main body 14 at a position rearwardly of sidewalls 16 and 18, and defines a central bore 34 therethrough which is in open communication with channel 14*a*.

A disposable inner member 36 includes a main body 38 having downwardly and outwardly extending wing members 40 connected together by a top wall 41. The inner surfaces of wing members 40 can have a material 42 with a roughened surface secured thereto for gripping various items such as a doorknob, paper towel dispenser handle, etc. A tongue 44 extends contiguously from the front end of main body 38 and includes an opening 46 near the front end thereof. A hollow cylindrical member 48 extends contiguously from the rear end of main body 38 and includes a central bore 50 therethrough. The outer diameter of hollow cylindrical member are slightly smaller than the inner diameter of cylindrical member 32 in order to permit hollow cylindrical member 48 to snugly fit within cylindrical member 32. Because inner member 36 is disposable, it can be formed from any inexpensive disposable material, such as cardboard, paperboard, plastic, etc.

In operation, disposable inner member 34 is fitted into outer member 12 by positioning hollow cylindrical member 48 within cylindrical member 32. In this position, wing members 40 are held against sidewalls 16 and 18, and openings 24 and 46 are in alignment with each other.

In such case, a person holds onto the outer surfaces of upper portions 16*a* and 18*a* of sidewalls 16 and 18 and can pinch sidewalls 16 and 18 toward each other. This causes wing members 40 to move toward each other so that roughened surfaces 42 will grasp an item, such as a doorknob, handle of a paper towel dispenser, soap dispenser, etc., for actuating the same without the person having to touch these items. Because of the resilience of the materials, when the finger biasing force is released, side walls 16 and 18 will return to their unbiased position.

If the person desires to flush a urinal, the person fits the flush handle of the urinal into central bore 50 of hollow cylindrical member 48 and pushes down on assembly 10. Thereafter, assembly 10 is removed from the flush handle.

In order to flush a toilet, the user places the flush handle of the toilet within openings 24 and 46 and pulls down on assembly 10, thereby pulling down the flush handle. Assembly 10 is then removed from the flush handle.

When disposable inner member 36 becomes dirty or soiled, or a user merely desires to change the same after a single use or multiple uses, it is only necessary to remove disposable inner member 36 inner from outer member 12 and insert a new disposable inner member 36 within outer member 12, and then disposing of the old soiled disposable inner member 36.

Assembly 10 can easily be held to a belt or the like of a person by means of V-shaped member 26, by fitting the belt through transverse opening 28.

Figure 7:
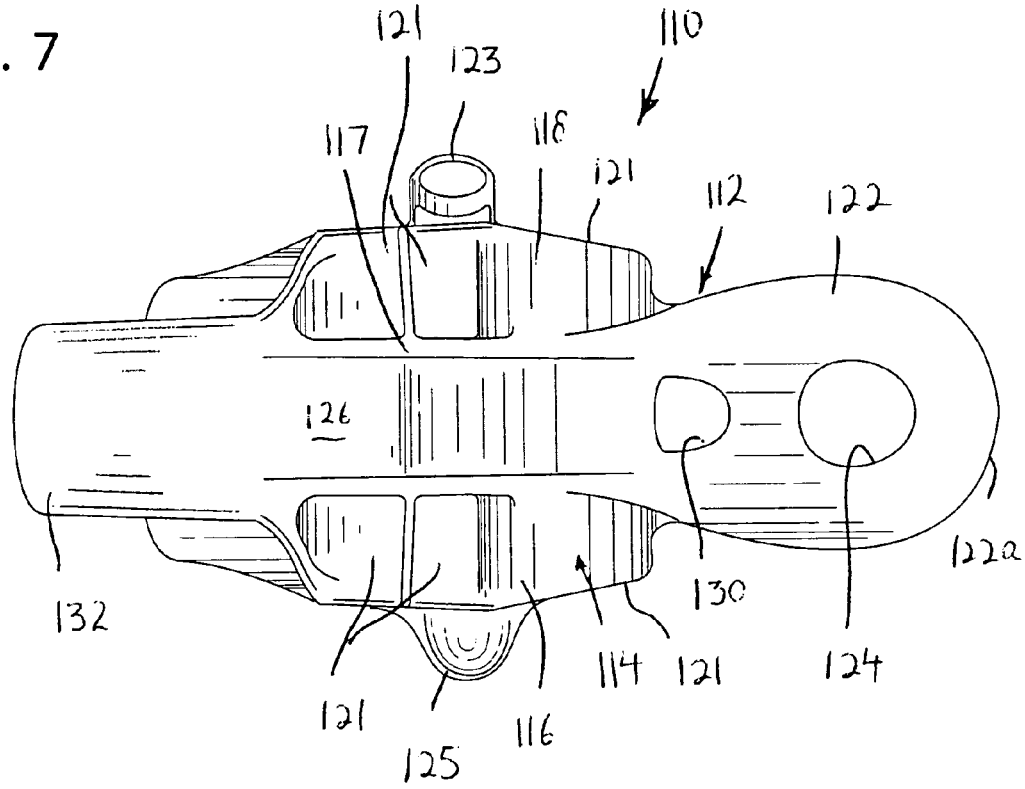
FIG. 7 is a top plan view of a combination urinal/toilet flusher and grabber assembly according to a second embodiment of the present invention.
Figure 8:
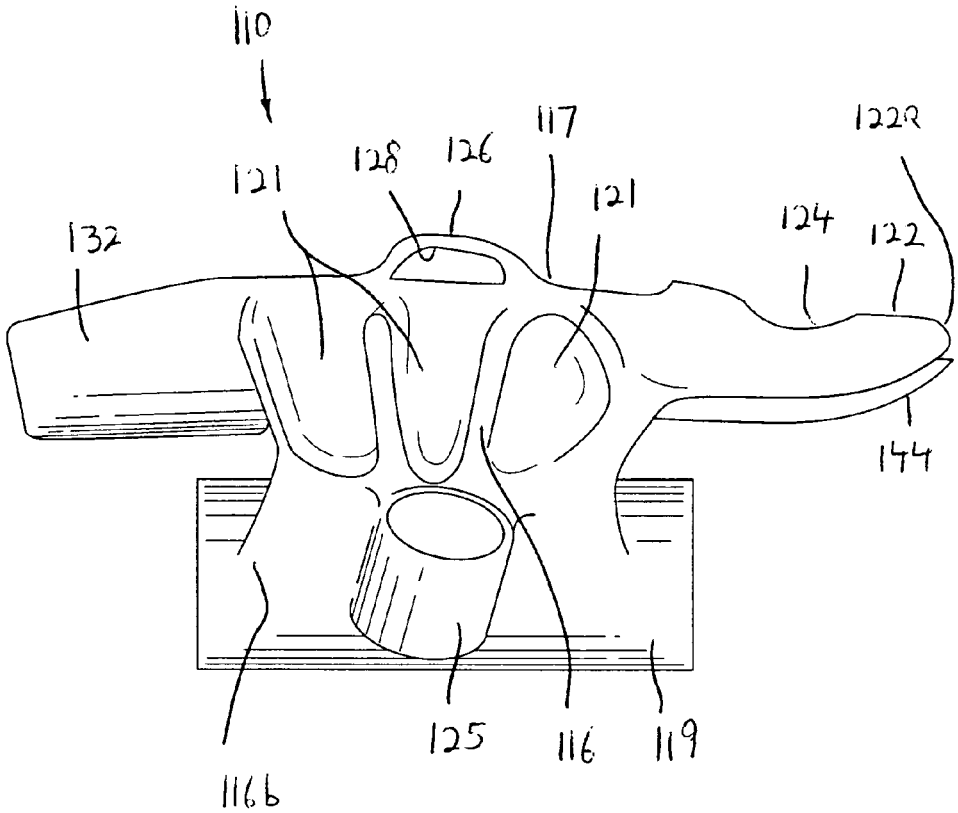
FIG. 8 is a right side elevational view of the combination urinal/toilet flusher and grabber assembly of FIG. 7.
Figure 9:
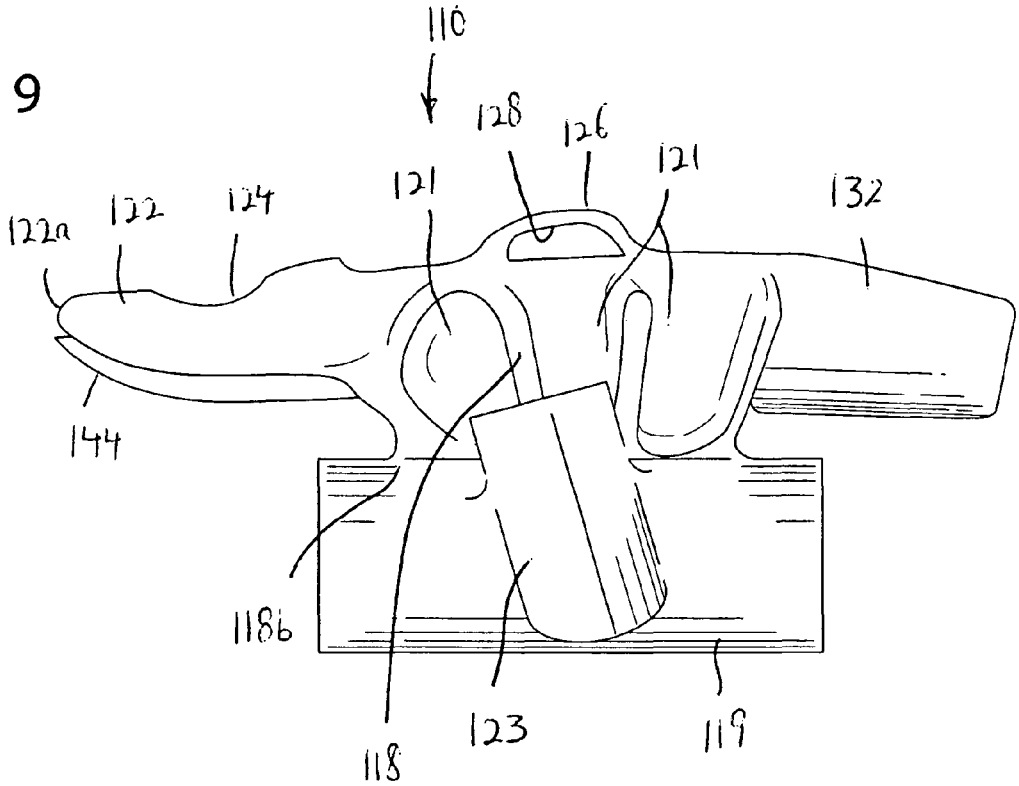
FIG. 9 is a left side elevational plan view of the combination urinal/toilet flusher and grabber assembly of FIG. 7.
Figure 10:
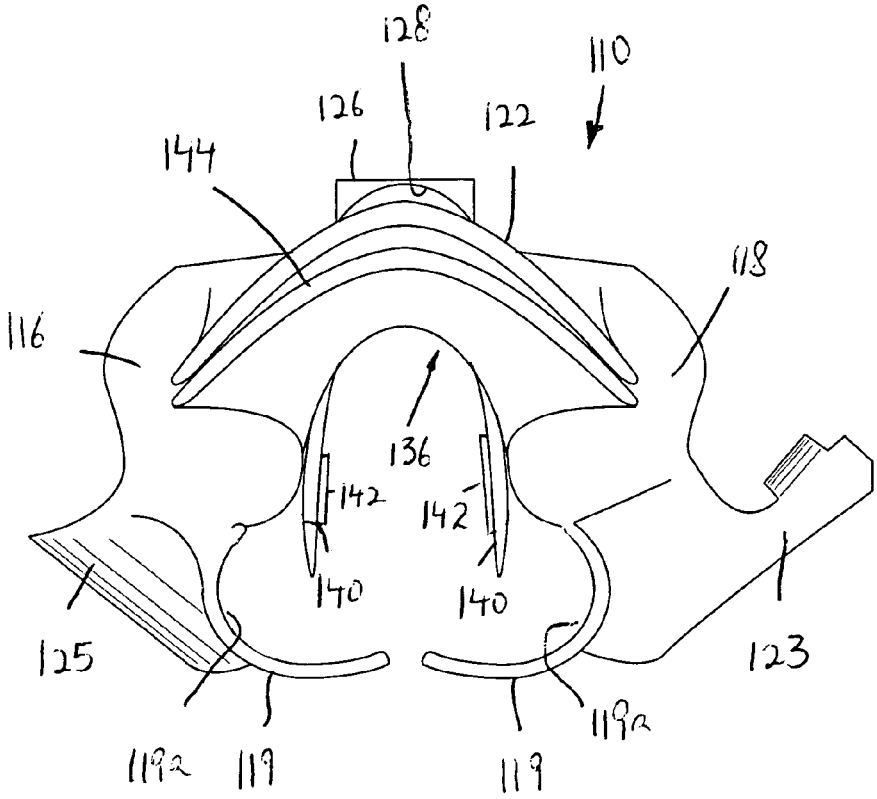
FIG. 10 is a front elevational view of the combination urinal/toilet flusher and grabber assembly of FIG. 7.
Figure 11:
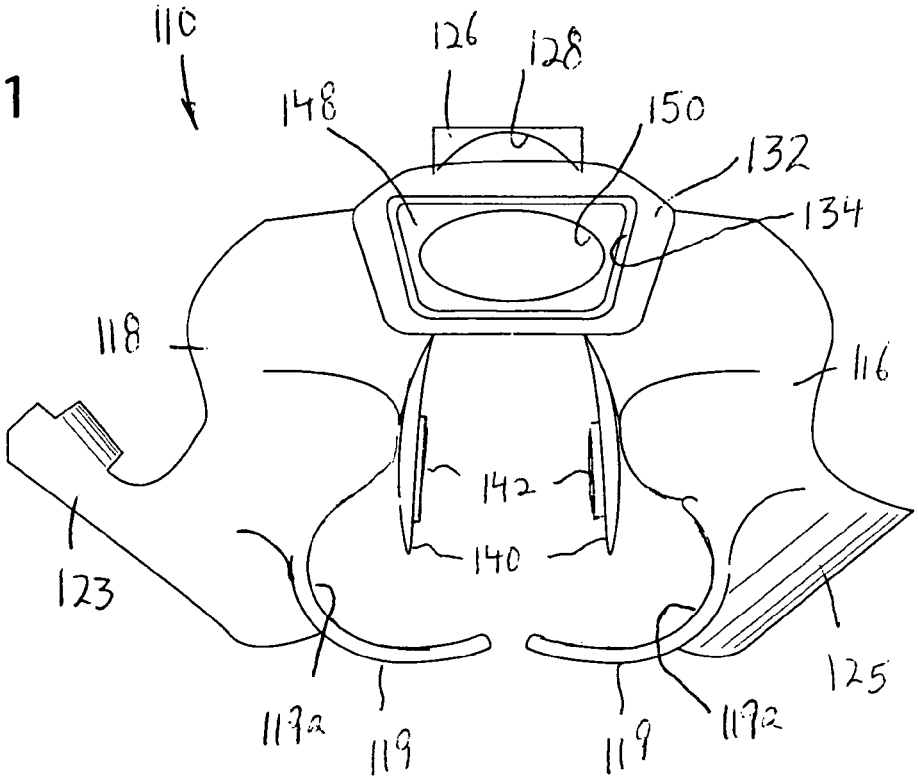
FIG. 11 is a rear elevational view of the combination urinal/toilet flusher and grabber assembly of FIG. 7.
Figure 12:
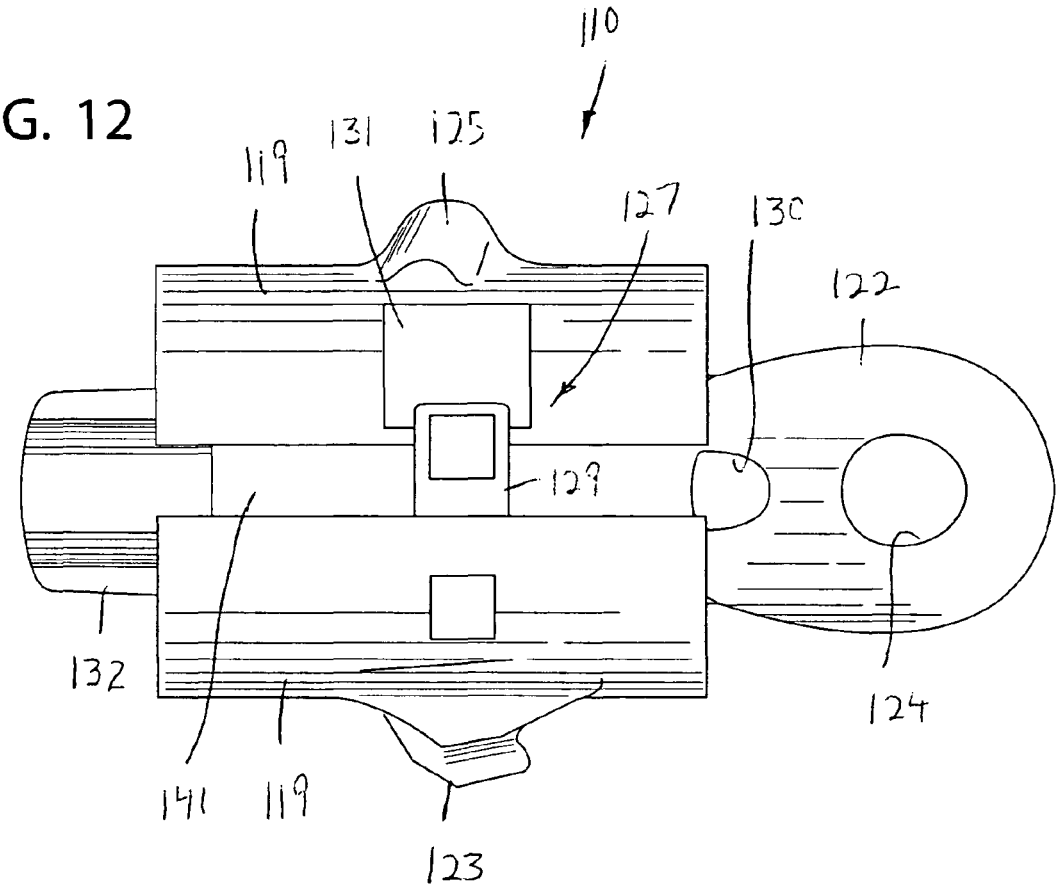
FIG. 12 is a bottom plan view of the combination urinal/toilet flusher and grabber assembly of FIG. 7.
Figure 13:
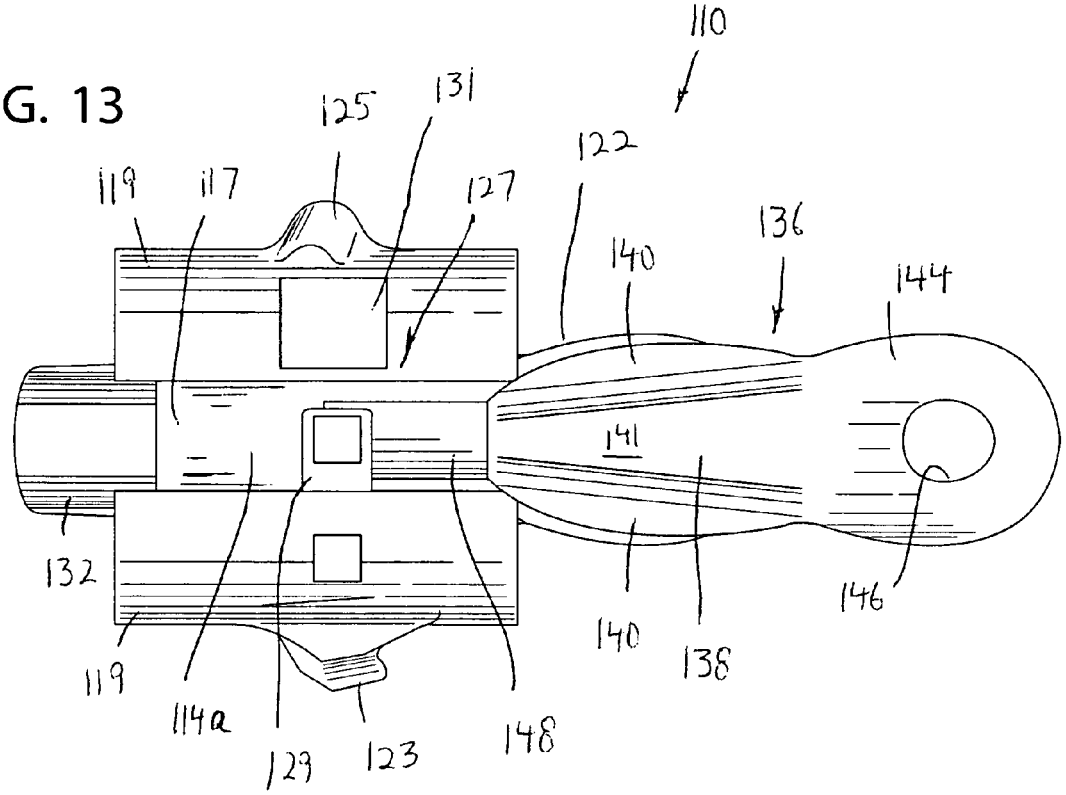
FIG. 13 is a partially exploded bottom plan view of the combination urinal/toilet flusher and grabber assembly of FIG. 7.

Referring now to FIGS. 7-13, a combination urinal/toilet flusher and grabber assembly 110 according to a second embodiment of the present invention will now be discussed, in which elements corresponding to urinal/toilet flusher and grabber assembly 10 of the first embodiment are identified by the same numerals but augmented by 100.

Combination urinal/toilet flusher and grabber assembly 110 includes an outer member 112 which is to be held by a user. Outer member 112 includes a main U-shaped body 114 having downwardly and outwardly diverging sidewalls 116 and 118 connected together by a top wall 117. A channel 114*a* is defined between sidewalls 116 and 118. Thin-walled semi-cylindrical grabbing members 119 are each connected at one straight edge thereof to lower edges 116*b* and 118*b*, respectively, of sidewalls 116 and 118, and extend' outwardly therefrom, such that the inner concave surfaces 119*a* thereof face each other.

Further, walls defining spaced apart finger recesses 121 are provided on the outer surface of each side wall 116 and 118. Also, a hollow finger receiving extension 123 is provided on the outer surface of one thin-walled semi-cylindrical grabbing member 119, while a hollow finger receiving housing 125 is provided on the outer surface of the other thin-walled semi-cylindrical grabbing member 119. In this manner, a person can selectively insert fingers in finger recesses 121, hollow finger receiving extension 123 and/or hollow finger receiving housing 125 in order to move side walls 116 and 118 toward each other, and thin-walled semi-cylindrical grabbing members 119 toward each other. Because of the resilience of the materials, when the finger biasing force is released, side walls 116 and 118 and thin-walled semi-cylindrical grabbing members 119 will return to their unbiased position.

In addition, an upwardly extending substantially U-shaped member 126 having a transverse opening 128 is secured to the upper surface of main body 114. A portion of main body 114 and/or tongue 122 can be cut-away at opening 130 to help form U-shaped member 126.

A forwardly extending tongue 122 extends contiguously from the front of main body 114 and has a length similar to that of main body 114. Tongue 122 has a generally rounded front edge 122*a* and includes a central opening 124 near the front end thereof.

A rearwardly extending tubular member 132 extends contiguously from the rear edge of main body 114 at a position rearwardly of sidewalls 116 and 118, and defines a central bore 134 therethrough which is in open communication with channel 114*a*.

A disposable inner member 136 includes a main body 138 having downwardly and outwardly extending wing members 140 connected together by a top wall 141. The inner surfaces of wing members 140 can have a material 142 with a roughened surface secured thereto for gripping various items such as a doorknob, paper towel dispenser handle, etc. A tongue 144 extends contiguously from the front end of main body 138 and includes an opening 146 near the front end thereof. A hollow tubular member 148 extends contiguously from the rear end of main body 138 and includes a central bore 150 therethrough. The outer diameter of hollow cylindrical member are slightly smaller than the inner diameter of tubular member 132 in order to permit hollow tubular member 148 to snugly fit within tubular member 132. Because inner member 136 is disposable, it can be formed from any inexpensive disposable material, such as cardboard, paperboard, plastic, etc.

In operation, disposable inner member 134 is fitted into outer member 112 by positioning hollow tubular member 148 within tubular member 132. In this position, wing members 140 are held against sidewalls 116 and 118, and openings 124 and 146 are in alignment with each other.

In such case, a person selectively inserts fingers in finger recesses 121, hollow finger receiving extension 123 and/or hollow finger receiving housing 125 in order to move side walls 116 and 118 toward each other. This causes wing members 140 to move toward each other so that roughened surfaces 142 will grasp an item, such as a doorknob, handle of a paper towel dispenser, soap dispenser, etc., for actuating the same without the person having to touch these items.

In addition, a person can selectively insert fingers in finger recesses 121, hollow finger receiving extension 123 and/or hollow finger receiving housing 125 in order to move thin-walled semi-cylindrical grabbing members 119 toward each other. In this manner, a person can grab a can, bottle, etc. For example, if there is a bottle on the floor that the person desires to throw in the garbage without touching the same, the person can pick up the bottle with grabbing members 119. In like manner, if a person wants to carry a drink bottle or the like when assembly 110 is on the person's belt, the drink bottle is held by grabbing members 119, and a further securement assembly 127 is provided thereon. For example, as shown, the securement assembly 127 can include a strap 129 on one grabbing member 119 which is secured to the other grabbing member 119 by any suitable engagement means 131, such as snaps, buttons, a hook and loop engagement arrangement sold under the trademark "VELCRO" or the like.

If the person desires to flush a urinal, the person fits the flush handle of the urinal into central bore 150 of hollow tubular member 148 and pushes down on assembly 110. Thereafter, assembly 110 is removed from the flush handle.

In order to flush a toilet, the user places the flush handle of the toilet within openings 124 and 146 and pulls down on assembly 110, thereby pulling down the flush handle. Assembly 110 is then removed from the flush handle.

When disposable inner member 136 becomes dirty or soiled, or a user merely desires to change the same after a single use or multiple uses, it is only necessary to remove disposable inner member 136 inner from outer member 112 and insert a new disposable inner member 136 within outer member 112, and then disposing of the old soiled disposable inner member 136.

Assembly 110 can easily be held to a belt or the like of a person by means of U-shaped member 126, by fitting the belt through transverse opening 128.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention defined by the appended claims.

What is claimed is:

1. A combination urinal/toilet flusher and grabber assembly, comprising an outer member including:

a first elongated, resilient, substantially U-shaped main body having spaced apart side walls connected by a top wall, with said main body including a first opening that extends along a substantial length of the main body at a bottom thereof between free ends of said spaced apart side walls, such that an object is adapted to be grasped by compression of outer surfaces of said side walls toward each other, and a first hollow member extending from one end of said elongated main body and having a second opening which is separate and distinct from said first opening for receiving a urinal/toilet flusher handle;

an inner member removably held within said outer member, said inner member including:

a second resilient main body having spaced apart wings connected together by a top wall, and a second hollow member extending from one end of said second main body for receiving a urinal/toilet flusher handle, said second hollow member being dimensioned to removably fit within said first hollow member such that said wings are positioned between said side walls and such that an object can be grasped by said wings by compression of outer surfaces of said side walls toward each other.

2. A combination urinal/toilet flusher and grabber assembly according to claim 1, wherein said hollow member has a generally hollow cylindrical shape.

3. A combination urinal/toilet flusher and grabber assembly according to claim 1, wherein said side walls include finger receiving portions on an outer surface thereof for providing said compression.

4. A combination urinal/toilet flusher and grabber assembly according to claim 1, further comprising grabber members secured to lower ends of said side walls for grabbing a generally cylindrical object.

5. A combination urinal/toilet flusher and grabber assembly according to claim 4, wherein each said grabber member has a generally semi-cylindrical configuration having a concave inner surface, and the concave inner surfaces of said semi-cylindrical grabber members face each other.

6. A combination urinal/toilet flusher and grabber assembly according to claim 4, wherein at least one of said grabber members includes a finger receiving member on an outer surface thereof for providing said compression.

7. A combination urinal/toilet flusher and grabber assembly according to claim 1, wherein at least a portion of an inner surface of each wing includes a roughened section for gripping of the object.

8. A combination urinal/toilet flusher and grabber assembly, comprising an outer member including:

a first elongated, resilient, substantially U-shaped main body having spaced apart side walls connected by a top wall, with said main body including a first opening that extends along a substantial length of the main body at a bottom thereof between free ends of said spaced apart side walls, such that an object is adapted to be grasped by compression of outer surfaces of said side walls toward each other, a first hollow member extending from one end of said elongated main body and having a second opening which is separate and distinct from said first opening for receiving a urinal/toilet flusher handle, and a first tongue extending from an opposite end of said elongated main body, said tongue including a third opening which is separate and distinct from said first and second openings for receiving a urinal/toilet flusher handle.

9. A combination urinal/toilet flusher and grabber assembly according to claim 8, wherein said hollow member has a generally hollow cylindrical shape.

10. A combination urinal/toilet flusher and grabber assembly according to claim 8, wherein said side walls include finger receiving portions on an outer surface thereof for providing said compression.

11. A combination urinal/toilet flusher and grabber assembly according to claim 8, further comprising grabber members secured to lower ends of said side walls for grabbing a generally cylindrical object.

12. A combination urinal/toilet flusher and grabber assembly according to claim 11, wherein each said grabber member has a generally semi-cylindrical configuration having a concave inner surface, and the concave inner surfaces of said semi-cylindrical grabber members face each other.

13. A combination urinal/toilet flusher and grabber assembly according to claim 11, wherein at least one said grabber member includes a finger receiving member on an outer surface thereof for providing said compression.

14. A combination urinal/toilet flusher and grabber assembly according to claim 8, further comprising an inner member removably held within said outer member.

15. A combination urinal/toilet flusher and grabber assembly according to claim 14, wherein said inner member includes:

a second resilient main body having spaced apart wings connected together by a top wall, a second hollow member extending from one end of said second main body for receiving a urinal/toilet flusher handle, said second hollow member being dimensioned to removably fit within said first hollow member such that said wings are positioned between said side walls such that an object can be grasped by said wings by compression of outer surfaces of said side walls toward each other, and a second tongue extending from an opposite end of said second main body, said tongue including an opening for receiving a urinal/toilet flusher handle.

16. A combination urinal/toilet flusher and grabber assembly according to claim 15, wherein at least a portion of an inner surface of each wing includes a roughened section for gripping of the object.

* * * * *